US012150510B2

(12) United States Patent
Storey

(10) Patent No.: US 12,150,510 B2
(45) Date of Patent: Nov. 26, 2024

(54) HELMET

(71) Applicant: GEORGE TFE SCP, Monaco (MC)

(72) Inventor: Piers Christian Storey, Nice (FR)

(73) Assignee: GEORGE TFE SCP, Monaco (MC)

( * ) Notice: Subject to any disclaimer, the term of this patent is extended or adjusted under 35 U.S.C. 154(b) by 11 days.

(21) Appl. No.: 17/782,644

(22) PCT Filed: Dec. 15, 2020

(86) PCT No.: PCT/EP2020/086172
§ 371 (c)(1),
(2) Date: Jun. 4, 2022

(87) PCT Pub. No.: WO2021/122564
PCT Pub. Date: Jun. 24, 2021

(65) Prior Publication Data

US 2023/0010873 A1 Jan. 12, 2023

(30) Foreign Application Priority Data

Dec. 18, 2019 (EP) ..... 19020702

(51) Int. Cl.
*A42B 3/06* (2006.01)
*A42B 3/12* (2006.01)

(52) U.S. Cl.
CPC ..... *A42B 3/064* (2013.01); *A42B 3/065* (2013.01); *A42B 3/124* (2013.01)

(58) Field of Classification Search
CPC ..... A42B 3/064; A42B 3/065; A42B 3/124
USPC ..... 2/411
See application file for complete search history.

(56) References Cited

U.S. PATENT DOCUMENTS

2015/0047110 A1* 2/2015 Chilson ..... A42B 3/28 29/283.5
2019/0231018 A1* 8/2019 Boutin ..... A42B 3/124

FOREIGN PATENT DOCUMENTS

EP 1694152 B1 6/2008
EP 3000341 A1 * 3/2016 ..... A42B 3/065
EP 3422887 A1 1/2019
EP 3130243 A1 7/2020
(Continued)

OTHER PUBLICATIONS

JP2007254920A English Translation—Shock Absorbing Material for Helmets—2007.*
(Continued)

*Primary Examiner* — Alissa J Tompkins
*Assistant Examiner* — Catherine M Ferreira
(74) *Attorney, Agent, or Firm* — Jason L DeFrancesco

(57) ABSTRACT

Helmet for sport activities comprising a lattice structure shaped so to accommodate a part of a user head and comprising empty and full portions arranged so that a continuous network of interconnected air channels runs through the lattice structure. The lattice structure comprises on its inner side at least one pocket permeable to air. The pocket is shaped so to accommodate said at least one permeable energy absorbing pad. Method for manufacturing the helmet comprising the steps of providing a lattice structure shaped so to receive a part of a user head and comprising at least one inner pocket, and inserting at least one energy absorbing pad which is permeable to air into said at least one pocket.

10 Claims, 7 Drawing Sheets

(56) References Cited

FOREIGN PATENT DOCUMENTS

| | | | | |
|---|---|---|---|---|
| JP | 2007254920 A | * | 10/2007 | |
| WO | WO-2017152151 A1 | * | 9/2017 | ..... A42B 3/064 |

OTHER PUBLICATIONS

International Search Report dated Mar. 22, 2021 received for PCT application n. PCT/EP2020/086172.
European search report and opinion dated Jun. 4, 2020 for received for EP application n. EP19020702.

* cited by examiner

-prior art-

-prior art-

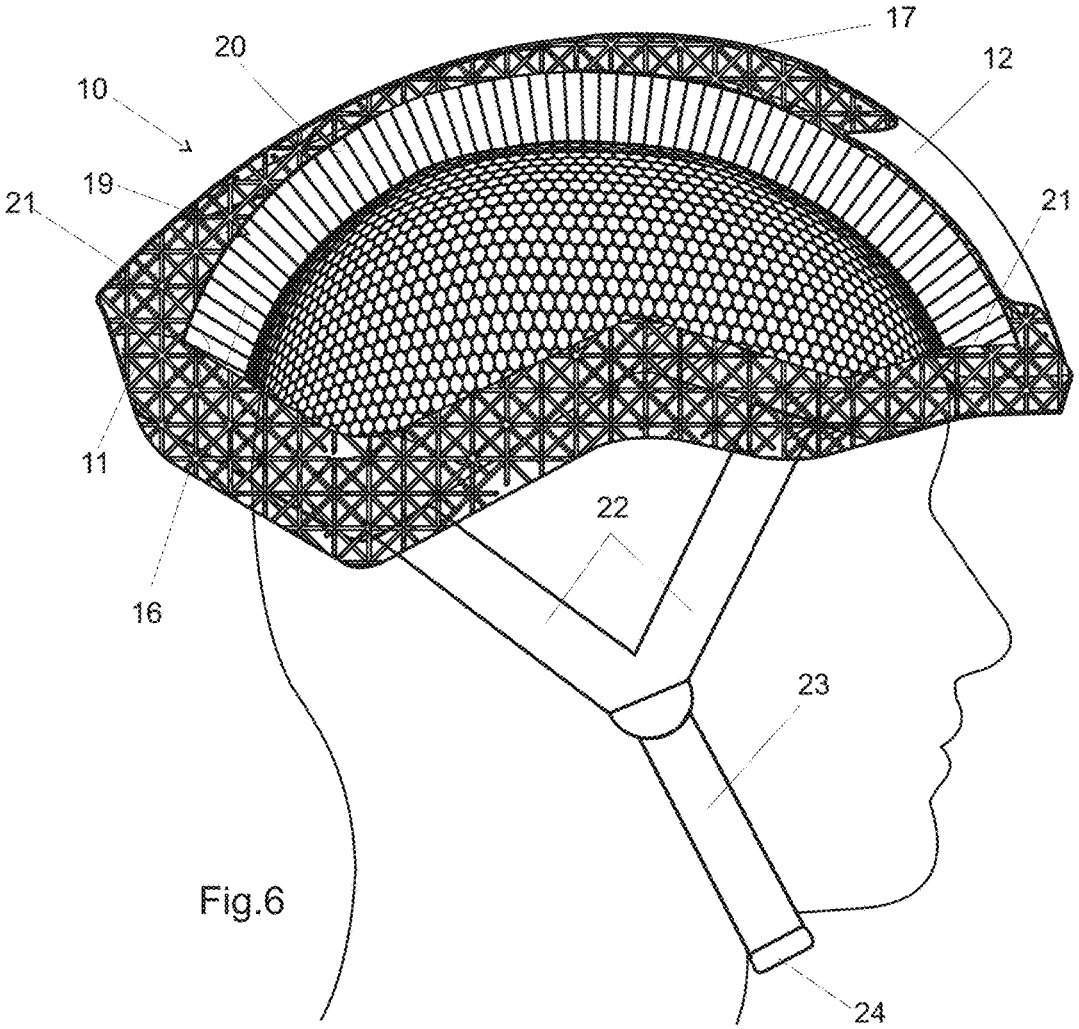
Fig.6
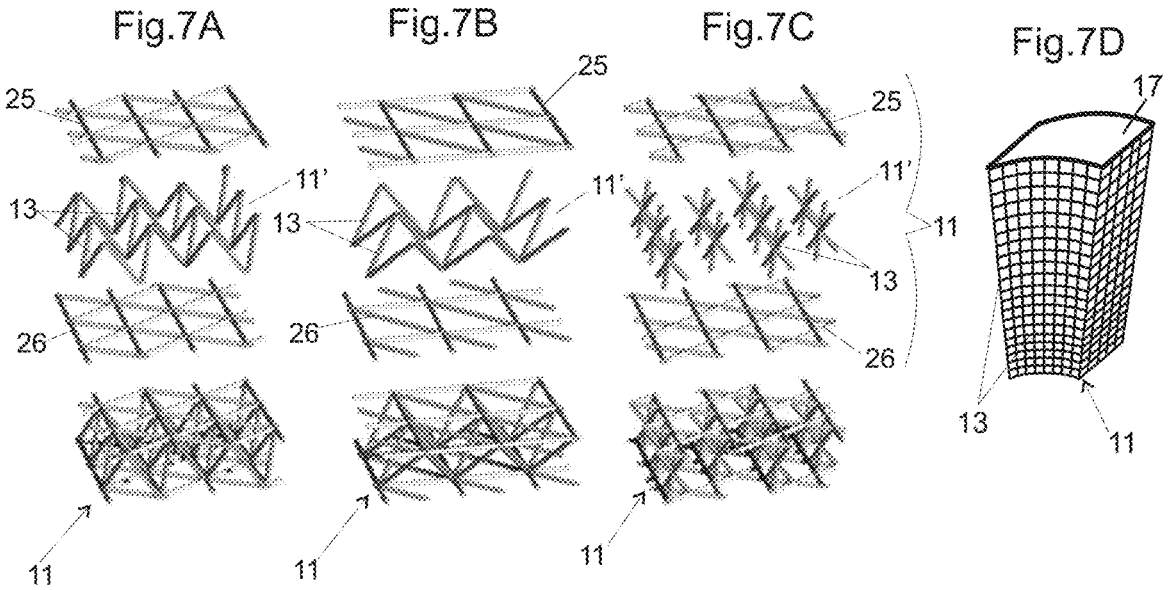

HELMET

TECHNICAL FIELD

The present invention relates to a helmet for sport activities for safeguarding the head against impacts.

BACKGROUND ART

In the state of the art several types of helmets exist: motorcycle helmets, automotive race helmets, industrial safety helmets, hard-hats, bike helmets, ski helmets, water-sports helmets, equestrian helmets, American football helmets, etc.

The present invention relates mainly to helmets for sporting activities, but it's not limited to them.

Traditional sport helmets comprise:

- a thin shell or an external cover;
- a protective padding matching with the shell and arranged into the shell;
- a comfort padding for making the helmet much more comfortable when it's worn by the user;
- a retention system, generally comprising a strap and a quick-release locking system.

Said shell gives to the helmet a specific appearance and allows to protect and contain the protective padding. The material of the shell can be a polymer such as PC (polycarbonate), PE (polyethylene), ABS (acrylonitrile butadiene styrene) or a composite material such as glassfibre or carbon fibre. Depending on the material, the shell is generally thermomoulded or thermo-formed, for example in bike helmets, or injection-moulded, for example in sky helmets.

The protective padding is made of polymeric foam, generally EPS (Expanded Polystyrene) or EPP (Expanded Polypropylene), and is used for absorbing the energy generated during a collision. The EPS pad or layer absorbs the energy of an impact through compression. In bike helmets, since the shell layer is very thin like a skin, it assumes the shape of the EPS layer. In general, the appearance of the sport helmet depends on the shape of EPS layer.

The comfort padding can comprise pillows made of synthetic or natural material, which adhere to the internal side of the protective padding. In this way, the head of the user is not in direct contact with the protective padding but with the comfort padding that is much more comfortable.

The retention system is used for maintaining the helmet in position on the head of the user and can comprise a regulation device for regulating the tightening of the helmet on the head.

Helmets for sport are considered by users like sportswear and for this reason the external shape of these helmets changes quite often because of current fashion. Consequently, a sport helmet needs to be redesigned regularly. Redesigning a helmet implies that external and consequently internal architectures change.

Currently EPS is the most used material for absorbing the energy of an impact and it is used for the large part of helmets. The performance of EPS is reduced from variations in temperature and humidity. For example, in hot temperature the EPS becomes soft and in cold temperatures it becomes hard and brittle. Consequently, the validity period of a protecting padding is generally not more than 5 years. For this reason, certain helmet manufacturers suggest replacing the helmet after a predetermined period of time. Furthermore, the overall dimension and shape of actual sport helmets strictly depend on the thickness of the protective padding. Helmet performance can only be improved by increasing the thickness or changing the EPS specification.

In the state of the art are also known improved helmets that substitute part of the energy absorbing function of EPS with other kinds of impact absorbing structures. Example in this sense are the helmets comprising energy absorbing pads, like that distributed with brand Koroyd®. This kind of helmet 100 comprises an external shell 104 made of PC, PE or ABS, under which a layer made of EPS 101 is arranged. This shell 104 is holed only in correspondence of few apertures 103. Below the EPS layer 101 one or more of energy absorbing pads 102 are arranged, as shown in FIG. 1A and 1B, in order to form the protective padding.

Koroyd® is an energy absorbing structure consisting of cylindrical polymeric cells joined each other along their sides so to realize a compact and resistant energy absorbing pad, as patent EP1694152B1 describes.

Other similar energy absorbing pads are known in the art, for example the honeycomb cells of patent application EP3422887A1.

The EPS layer of this type of helmet comprises recesses wherein energy absorbing pads, like that named Koroyd®, are partially housed. Differently from the traditional sport helmet wherein the protective function is provided by the EPS layer, in this type of helmet, the impacts are absorbed by both EPS layer and energy absorbing pads. This construction offers helmet designers the opportunity to alter many more variables in the helmet design to further optimise the helmet's performance.

The EPS layer 101 of this kind of helmet has a very complex shape, as shown in FIGS. 1, and comprises a lot of cavities 106. Each cavity 106 has a predetermined shape so to admit an energy absorbing pad 102 or to enable the passage of air. In the portions of the EPS layer 101 not having cavities 106, the thickness is higher. Normally, in this kind of helmets 100, the energy absorbing pads 102 are almost entirely contained in the EPS layer 101.

With reference to FIG. 1B, the EPS layer 101 with these cavities 106 is normally realized by moulding. In order to realize these internal cavities 106, the positive mould portion 120 can comprise tens of detachable inserts 130 that need to be connected to each other before assembling the mould and placing the polystyrene beads into the mould. The same applies also to the negative mould portion 110, that is realized with many other pieces. Once the polystyrene beads are expanded into the mould and the layer 101 is solidified, the negative mould portion 110 is detached and disassembled, while the positive mould portion 120 must be dismounted piece by piece in order to extract the positive mould 120 from the EPS layer without damaging the latter. This activity is very complicated and very time-consuming. Moreover, if the helmet sizes are several, for example small/medium/large, moulds are more than one and the manufacturing complexity increases. None of the known solution solved the problem of providing an alternative to this very complicated way of realizing the EPS layer for these types of sport helmets.

Furthermore, the thickness T3 of the protective padding is comprised in a predetermined range in sport helmets, which normally can vary between 18 mm and 30 mm. Since energy absorbing pad 102 has normally better performances in term of energy impact absorption with respect to EPS layer 101, better absorbing performances of the helmet would be obtainable by augmenting the thickness T2 of energy absorbing pad 102 to the detriment of EPS layer 101 thickness T1. For example, energy absorbing pad 102 named Koroyd® has a behaviour similar to a solid after a compression of 85% of its thickness, while EPS has a behaviour similar to a solid after a compression of 65% of its thickness, consequently a protective padding 105 made entirely by Koroyd® material would be ideal, but this solution is not possible because an energy absorbing pad 102 needs to be contained by a structure which provides to the helmet the external appearance and allows the connection of retaining straps. Moreover, a minimum thickness T1 of the EPS layer must be guaranteed in order to allow to the beads of polystyrene to fill completely the mould before their expansion and to avoid rupture of the EPS layer 101 during helmet production. Additionally, the external shape of the helmet needs to be changed often for following fashion evolutions. This is the reason why the EPS is still today the only affordable solution to all above mentioned problems and the average thickness of the EPS layer is never less than 10 mm in correspondence of the energy absorbing pads. Consequently, sport helmets are less effective than they could be.

Additionally, in order to improve the ventilation of sport helmets, the EPS layer 101 of helmets known in the art, comprises passing through apertures 103, as shown in FIG. 1A and 1B. These apertures 103 are realized to allow that a flow of air transits through the helmet 100 and reaches the head of the user. These apertures 103 represent a potential risk for the user, because any spike or pointed element, e.g. a tree branch, can enter these apertures 103 and reach the user's head 107 without obstacles. Even in said improved helmets comprising energy absorbing pads this is still a problem, because these pads are resistant to impact with objects having planar or curved surfaces, but they are fragile in case of impact with sharp objects. No helmets known in the art, with or without energy absorbing pads, allow a transit of an airflow sufficient to cool the head of the user without decreasing the safety for the user.

Furthermore, if a helmet comprises several apertures for facilitating airflow, the helmet structure becomes fragile and needs to be reinforced to prevent ruptures during an impact. Normally, in order to achieve this reinforcement, the density of the EPS is increased or a roll cage or a frame is co-moulded with EPS, but these reinforcement techniques reduce the performance of a helmet in case of an impact.

Furthermore, these apertures 103 are concentrated in certain points of the helmet, consequently the user's head is normally not efficiently cooled in a complete way.

In the state of the art are available known solutions for improving the air transit through the shell and protective padding, like that of patent application EP3130243A1 or US20190231018A1. In this solution, the shell and protective padding are made of a lattice structure and the 3D matrix of protective padding portion is conceived to absorb the energy of an impact. In this solution under the lattice protective padding is directly arranged the comfort padding and no other additional energy absorbing structures are present. For this reason the energy absorption of impacts is not optimized. According to this solution, the air is free to flow into the lattice structure of the helmet. The shell and protective padding of this helmet are entirely realized with the same material and this fact creates problems in term of structural strength of the helmet. Having a helmet made of different materials allow to differentiate the hardness and physical resistance to impacts, temperature, humidity and so on. Consequently, the helmet of EP3130243A1, that is conceived for being entirely made with the same material, risks to be too soft or too hard in certain conditions of temperature or humidity. For example in the range of temperature higher than 40° C. or lower than 0° C. this helmet can have problems in terms of mechanical resistance, consequently it can't be homologated in several countries. If the material is too hard, the shell protects the protective padding efficiently, but the lattice protective padding is too hard for absorbing efficiently the energy of an impact, and vice versa. Furthermore, EP3130243A1 discloses that a lattice structure is enough to absorb all impacts, without the need for any additional energy absorbing item or layer. In addition to this, helmets designed entirely with a lattice structures can presently only be manufactured through additive manufacturing or 3D printing. These processes are currently limited in terms of mechanical characteristic and performance of raw materials, mechanical weakness between each bonded layer of the 3D printing process, the time it takes to print and the high costs associated with 3D printing process. Furthermore, a helmet entirely made by additive manufacturing risks to be infeasible for the presence of several undercuts, and its production would be very expensive.

Other helmets are present in the state of the art, but none of them solve contemporary all the following problems with its architecture:

- permitting an efficient and complete ventilation of the head of a user wearing the helmet;
- improving the absorption of impact with respect to helmets comprising EPS protective padding or with respect to helmets entirely made by additive manufacturing;
- facilitating the manufacturing and the assembly of the helmet;
- reducing costs of production with respect to helmets entirely made through additive manufacturing;
- reducing the manufacturing complexity with respect to helmets entirely made through additive manufacturing;
- minimizing the elements constituting the helmet;
- improving the penetration resistance to spike or pointed elements .

Helmets known in the art favour one or two of the above-mentioned advantages but never all of them.

SUMMARY

Said inconvenients of the state of the art are now solved by a helmet for sport activities including a lattice structure shaped so to accommodate a part of a user head and comprising empty and full portions arranged so that a continuous network of interconnected air channels runs through the lattice structure. The helmet further comprises at least one energy absorbing pad permeable to air and the lattice structure comprises on its inner side at least one pocket permeable to air and shaped so to accommodate the at least one permeable energy absorbing pad.

In particular, the helmet can comprise an outer shell connected to the full portions of the lattice structure. Preferably the outer shell is monolithically connected to the full portions of the lattice structure. The outer shell is preferably configured to cover at least in part the lattice structure. The outer shell is preferably at least in part permeable to air, and more preferably said outer shell is a two-dimensional grid.

Further, the helmet can comprise an inner layer connected to the full portions of the lattice structure. Preferably the inner layer is monolithically connected to the full portions of the lattice structure. The inner layer is arranged between the lattice structure and the at least one permeable energy absorbing pad. Preferably said inner layer is at least in part permeable to air, and more preferably the inner layer is a two-dimensional grid.

The lattice structure comprises a unit cell that is repeated along principal axes of space so to create said lattice structure. Said principal axes are orthogonal to each other, and preferably are two or three of the X-axis, Y-axis, Z-axis.

Preferably the volume of said unit cell increases while moving radially from inside to outside of the lattice structure. More preferably, said volume increases along all principal axes of space, thus along X,Y,Z axes.

In particular, the at least one pocket comprises a base and at least a side wall, preferably said base and/or said side wall are permeable to air.

Each permeable energy absorbing pad comprises a plurality of cells and adjacent cells are interconnected with each other on a portion of their lateral surfaces to form an array of energy absorbing cells, preferably said adjacent cells bonded each other, preferably are thermally welded, glued or connected by an adhesive. The cells are oriented so that their longitudinal axes are substantially radially oriented with respect to a geometrical center of the helmet. In particular, the plurality of cells are tube-shaped, honeycomb-shaped, non-hexagonally-honeycomb-shaped, or form an open-cell foam.

The energy absorbing pad has an inner curved side, an outer curved side and an almost constant thickness between said inner and outer sides.

The helmet can also comprise an intermediate layer in-between said lattice structure and at least one energy absorbing pad, said intermediate layer is a low friction layer.

Preferably, the helmet can further comprise an EPS or EPP layer arranged below the lattice structure and beside or partially over the at least one energy absorbing pad so keep the at least one energy absorbing pad in respective at least one pocket.

The lattice structure of the helmet can be obtained through additive manufacturing, while the at least one energy absorbing pad can be formed by thermoforming. If the energy absorbing pad is made with auxetic honeycomb thermoforming is not required.

The helmet can comprise at least one blind vent recessed inwardly with respect to outer shell, and this at least one blind vent can be permeable to air.

A further object of the present invention is that of providing a helmet manufacturing method comprising the steps of providing a lattice structure shaped so to receive a part of a user head and comprising at least one inner pocket; and inserting at least one energy absorbing pad that is permeable to air into said at least one pocket. This method can comprise the preliminary sub-step of realizing through additive manufacturing said lattice structure comprising at least one pocket. This method can also comprise the step of bonding lateral surfaces of adjacent cells of energy absorbing pad to form a honeycomb panel, and the step of thermoforming on a curved mould the honeycomb panel so to give it a curved shape that fits with that of said pocket.

Further inconvenients are solved by the technical characteristic and details provided in the dependent claims of the present invention.

These and other advantages will be better understood thanks to the following description of different embodiments of said invention given as non-limitative examples thereof, making reference to the annexed drawings.

DRAWINGS DESCRIPTION

In the drawings:

FIG. 6 shows a cross-section of a helmet according to a fifth embodiment of the present invention;

FIG. 7A, 7B and 7C show different internal architectures of the lattice structure of present invention;

FIG. 7D shows a detail of a piece of a functional grading lattice structure according to a particular embodiment of the present invention;

DETAILED DESCRIPTION

The following description of one or more embodiments of the invention is referred to the annexed drawings. The same reference numbers indicate equal or similar parts. The object of the protection is defined by the annexed claims. Technical details, structures or characteristics of the solutions herebelow described can be combined with each other in any suitable way.

Figure 1A:
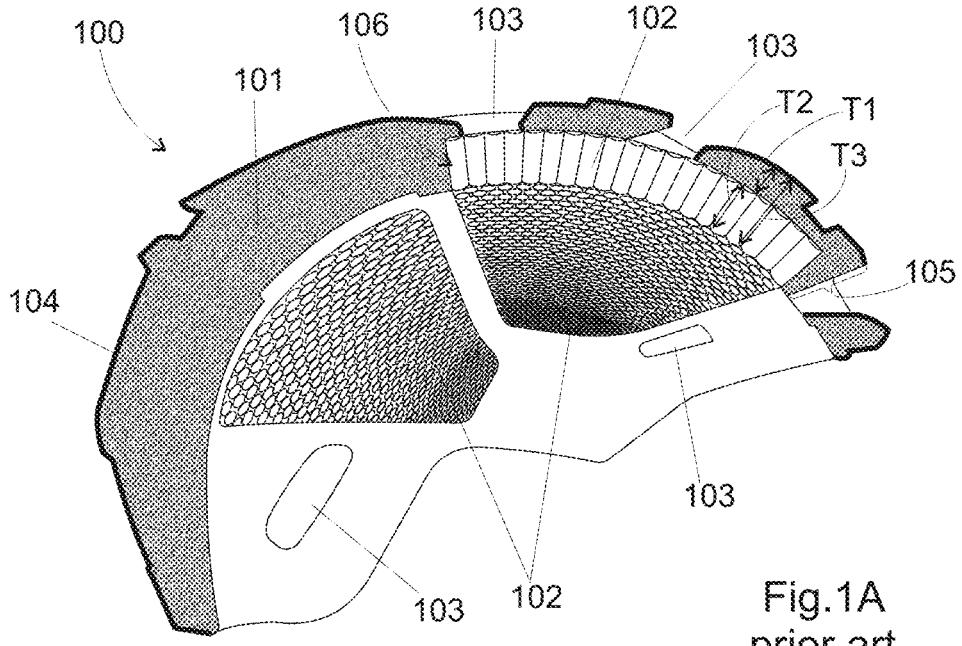
FIG. 1A shows a schematic view of a sectioned known helmet.
Figure 1B:
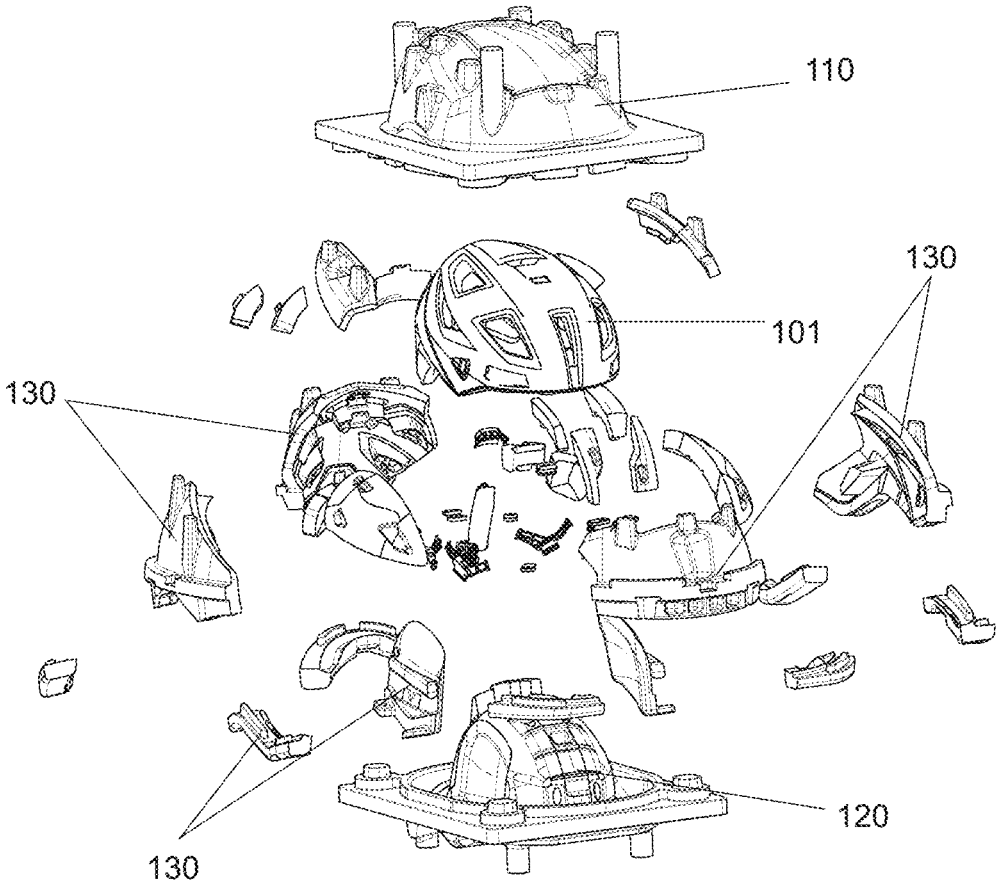
FIG. 1B shows an exploded view of the mould pieces required to mould an EPS helmet known in the art.
Figure 2:
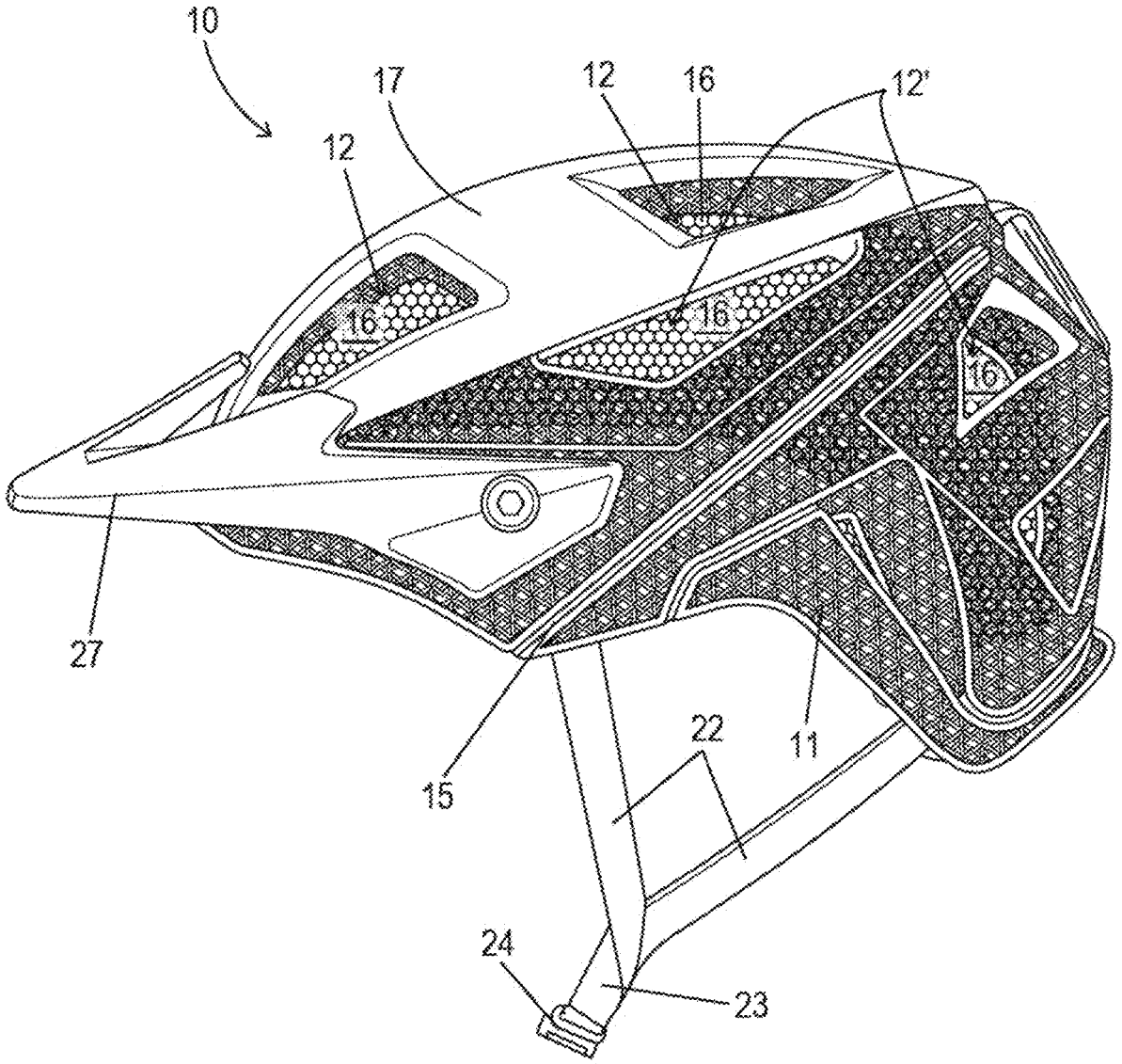
FIG. 2 shows a side view of a helmet according to a first embodiment of the present invention.

With reference to the FIG. 2 is illustrated a lateral view of a helmet for sport activities according to a first embodiment of the present invention. The helmet comprises a lattice structure 11 made by a three-dimensional grid of full portions 13, also called rods or beam, and empty portions 14. Said lattice structure 11 also comprises ribs 15 monolithically connected to said three-dimensional grid of rods 13. The empty portions 14 are interconnected with each other so to create a network of empty spaces in which the air can flow. The full portions 13 are organized and distributed according to a predetermined law of distribution. In the embodiment of FIG. 2, the full portions 13 of the lattice structure is of the stochastic type. The lattice structure 11 contributes to the external appearance of the helmet 10.

The lattice structure 11 also incorporates at least two plates (not shown) arranged on opposite lateral sides of the helmet 10, wherein the straps 22 of the retention system are connected. These plates are monolithically connected to the full portions of the lattice structure 11 so to discharge the strength applied by the straps 22 over the entire skeleton of the lattice structure 11. This connection of the straps 22 allows to guarantee a great resistance of the retention system despite the overall very low weight of the helmet 10. The straps 22 connected to the plates of the lattice structure 11 are of a classic type, well-known in the art by the skilled man.

The lattice structure 11 of this helmet 10 is covered by an outer shell 17 which covers the top portion of the lattice structure 11 as represented in FIG. 2. This external shell 17 is monolithically connected to the full portions 13 of the lattice structure 11. In a further embodiment (not represented), the shell 17 is connected to the lattice structure through glue, mechanical connections or any other connection means. The outer shell 17 covers also a part of the frontal portion of the helmet 10 and comprise a peak 27. The outer shell 17 protects from stronger impacts, in particular that with sharp elements. This outer shell 17 comprises some vents 12 for admitting air. Through this vents 12 is visible the permeable energy absorbing pad 16. The air is so able to cross the outer shell 17, the energy absorbing pad 16, and consequently to reach the head of user. The vents 12 of the outer shell 17 elongate in the lattice structure 11 up to the pocket 19 (not visible in FIG. 2). The lattice structure 11 of FIG. 2 also comprises further vents 12' arranged external with respect to the outer shell 17. These vents 12' cross the lattice structure 11 from its outer side to its inner side across its thickness.

Internally to the lattice structure 11 of FIG. 2 is arranged one single energy absorbing pad 16. The external side of this pad 16 is substantially shaped like a half-globe. This energy absorbing pad 16 is of the permeable type, thus it enables the transit of air across its thickness. As better described in the following, the air can transit through the energy absorbing pad 16 because a plurality of cells 28 constituting the pad 16 enables the transit of air through it. The lattice structure 11, which normally has a plurality of small cavities created by said empty portions, also comprises one additional large pocket 19 (not visible in FIG. 2) which is shaped so to admit the energy absorbing pad 16. The external side of this pad 16 matches with the bottom of the pocket 19 realized in the lattice structure 11. Moreover, wide lateral movements of the pad 16 are prevented because the lateral sides of the pocket 19 are shaped so to create an end stroke for the lateral movements of pad 16. This energy absorbing pad 16 is provided for absorbing the large part of energy created during an impact of the helmet 10 with an external object, minimizing injuries for the helmet wearer.

The lattice structure so conceived has a great appeal in term of external appearance and is extremely light in term of weight, improving its perceived comfort.

Figure 3:
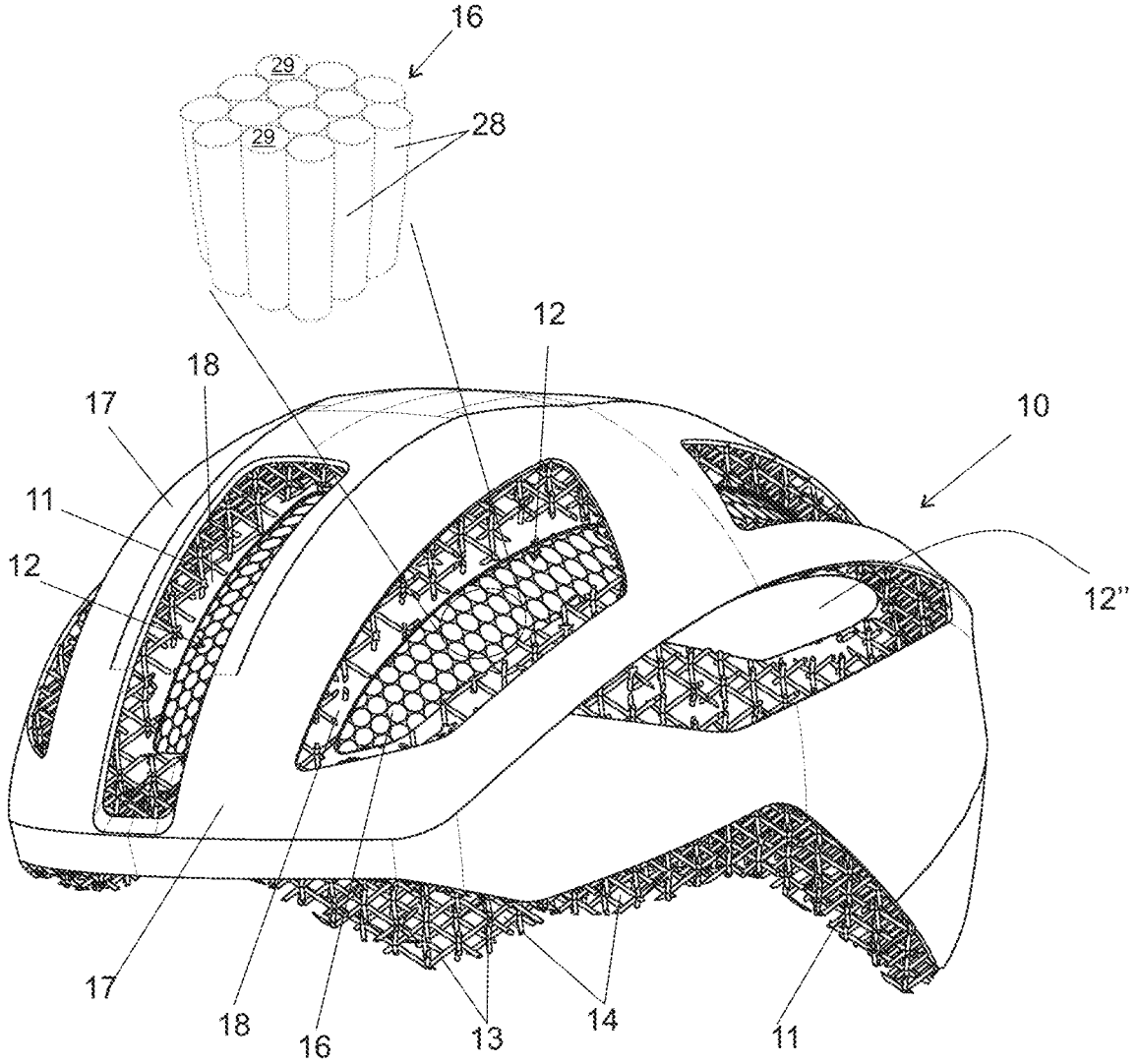
FIG. 3 shows an isometric view of a helmet according to a second embodiment of the present invention.

Reference is now made to FIG. 3 wherein is represented a second embodiment of the helmet according to the present invention. This embodiment is similar to the previous one. The lattice structure 1 of FIG. 3 comprises a unit cell that is of 3D Kagome type, as better represented in FIG. 7C. Alternatively, the lattice structure 11 could have a pyramidal or tetrahedral structural arrangements, as represented in FIG. 7B and 7A respectively. Other arrangement of the rods of the lattices structure 11 can be used, in particular are preferred the lattice structures wherein the full portions bend if the lattice structure 11 is compressed along a radial direction. The term radial means a direction oriented from the center of the helmet outwards, more specifically the term radial direction means a direction normal to the inner surface of the lattice structure, which substantially matches with the outer energy absorbing pad surface. A body centred cubic structure is a valid alternative to a 3D Kagome lattice structure because both have all rods arranged diagonally. All rods of these two structures converge toward the centre of an ideal cubic shape containing a sort of star of rods representing the unit cell of the lattice structure 11. According to the present invention, the term unit cell means the smallest repeating unit of the lattice structure 11, thus the smallest repeating motif. This motif/unit is repeated along principal axes, thus Cartesian axes, so to realize the lattice structure 11.In this type of unit cell, the full portions (rods) 13 are more exposed to bending and less to compression, increasing the capacity of the lattice structure 11 to absorb impacts. Bending-dominated lattice structures are preferable because they exhibit a flat stress plateau in their stress-strain curve, which is preferable for energy absorption of impacts. When an impact load is distributed onto the lattice structure 11, in the full portions 13 occur microstructural plastic deformations of the constituent material, which allows to absorb the energy of the impact.

Preferably, said lattice structure 11 of FIG. 3 externally ends with an outer shell 17, which is permeable to air thanks to large vents 12. Through these vents 12 is visible the energy absorbing pad 16 that is arranged internally and below the lattice structure 11. Specifically, the energy absorbing pad 16 is arranged into a pocket 19 (not perceivable in FIG. 3) of the lattice structure 11, as described in detail when reference is made to FIGS. 4 and 5.

Preferably, said lattice structure 11 of FIG. 3 internally ends with a continuous inner layer 18, which is configured to be permeable to air. The inner layer 18 acts as an inner shell. The inner layer 18 is continuous and has some holes which enable the transit of air. Certain holes of the inner layer 18 have substantially the same dimension of vents 12, while other holes are smaller and enable the transit of air toward the user head where the vents 12 are not present, allowing a more uniform distribution of air over the entire wearer's head. This inner layer 18 is monolithically connected with the lattice structure 11 so that innermost ends of rods 13 are indissolubly connected to the inner layer 18. The inner surface of the inner layer 18 is also configured to match with the energy absorbing pad 16.

In this way, the lattice structure 11 appears as a sandwich of three layers: an outer shell 17, the 3D grid of the lattice structure 11 and the inner layer 18, as shown in FIG. 7A-7C. This arrangement allows to absorb a higher quantity of energy with respect to other 3D lattice structures or EPS pads.

In the helmet of FIG. 3 some vents are blind so to form a cavity 12", thus the inner layer 18 in correspondence of these vent apertures is not completely opened. The air thus passes through the vents of outer shell 17,bumps over the inner layer 18 and laterally deviates in the lattice structure 11. In this way, the air pressure increases and the air accelerates into the lattice structure 11 allowing a more efficient distribution of air in the entire lattice structure 11. Contemporary, any sharp or point elements which strikes the helmet in correspondence of these vents, cannot penetrate up to the wearer's head, because is blocked by the inner layer 18.

As in the previous embodiment, the energy absorbing pad 16 consists of a plurality of tubular cells 28 bonded to each other along their sides so to create a curved pad which is permeable to air along its thickness direction.

Preferably, the helmet 10 of FIG. 3 also comprises an outer shell 17 which covers in part the lattice structure 11. This outer shell 17 is directly and monolithically connected to the external face of the lattice structure 11. In this way, the impacts received by the shell 17 are spread on a wide portion of the lattice structure 11 and the energy of the impacts is dissipated at best. Since the lattice structure 11 is made of unit cells having rods 28 inclined in vertical, horizontal and diagonal directions, at least a group of rods 28 is always arranged in the best manner for absorbing, by bending, the impact received on the shell 17. In this way the energy is always spread efficaciously. The outer shell 17 is preferably arranged in the region of lattice structure 11 wherein the cranium is more fragile, thus in correspondence of frontal, parietal and occipital regions of cranium. The outer shell 17 comprises one or more holes or vents for enabling the transit of air.

Figure 4:
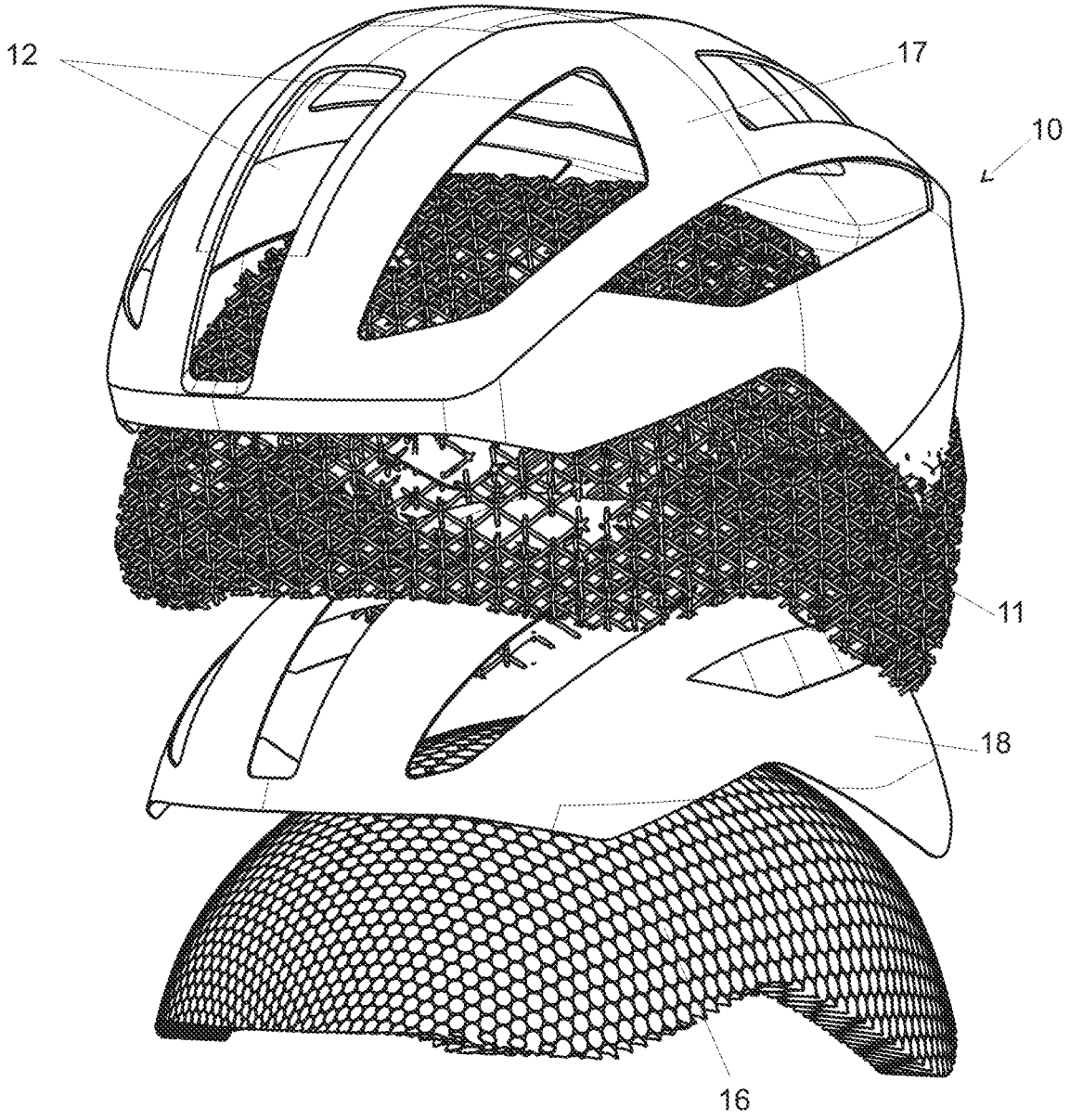
FIG. 4 shows an exploded view of a helmet according to third embodiment of the present invention.

The embodiment shown in FIG. 4, is exactly equal to that of FIG. 3, with the only difference that outer shell 17, inner layer 18 and lattice structure 11 are separated from each other. The helmet 10 is thus realized sandwiching the lattice structure 11 between outer shell 17 and inner layer 18. The energy absorbing pad 16 is then arranged into this sandwich in order to complete the helmet. In this embodiment, all vents 12 pass through the outer shell 17, the lattice structure 11 and the inner layer 18. No vents 12 are consequently blind. The outer shell 17 and the inner layer 18 are connected to the lattice structure 11 by an adhesive, glue or other equivalent connection means.

Figure 5:
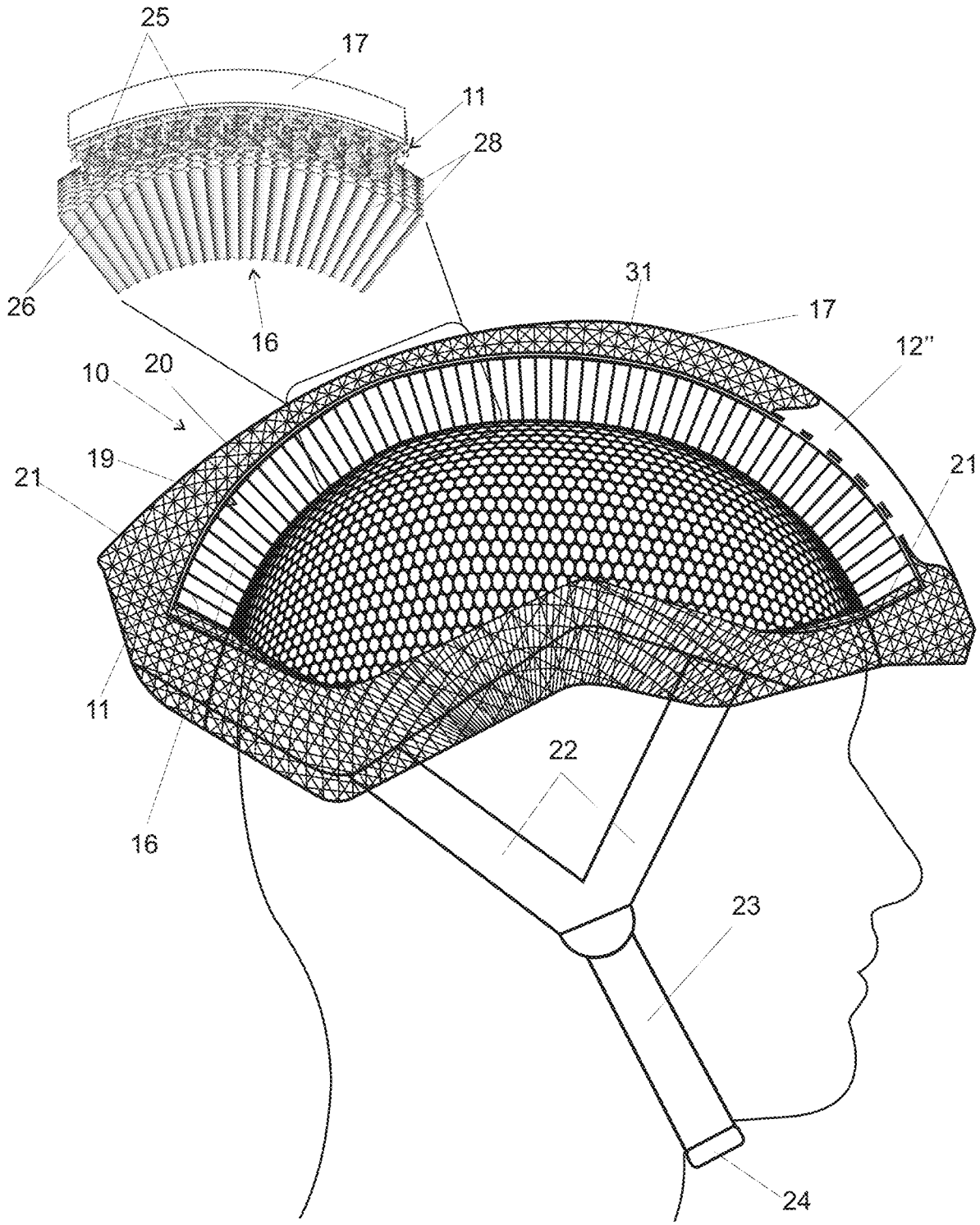
FIG. 5 shows a cross-section of a helmet according to a fourth embodiment of the present invention.

A further embodiment is shown in FIG. 5. This embodiment is similar to that of previous embodiments of FIG. 3 or 4. In this embodiment, the lattice structure 11 internally ends with a reticular smooth and curved surface consisting of a two-dimensional grid 26, as shown in detailed picture of FIG. 5. This inner 2D grid 26 is monolithically connected to the main body of the lattice structure 11 and almost each intersection of the 2D grid 26 is connected to the most inner ends of one of rods 28. This inner 2D grid 26 is a flat and curved surface shaped so to match with the external face of the energy absorbing pad 16. In this manner, the load of any impact received by the lattice structure 11 is efficiently spread on the energy absorbing pad 16 so to maximize the energy absorption effect and reducing risks for user's head. The inner 2D grid 26 of the lattice structure matches with the outer side of the energy absorbing pad 16.

Alternatively, the innermost ends of rods 13 of the lattice structure 11 are free ends that simply lean on the underlying layer's, like the energy absorbing pad 16.

In the embodiment of FIG. 5, the lattice structure 11 is externally covered by an outer shell 7 as described in the previous embodiment.

The outermost ends of the rods 13 of lattice structure 11 are monolithically connected to an outer two-dimensional grid 25, as shown in detailed picture of FIG. 5, that is smooth and curved. The shell 17 is arranged over the outer 2D grid 25 as shown in FIG. 5. A part of the outer 2D grid 25 is not covered by the shell 17 and remaining visible from outside. Thanks to this outer 2D grid 25, the load of an impact is efficiently spread through a wide portion of the lattice structure 11. The lattice structure 11 then distributes the impact load through its full portions 13 and on the inner two-dimensional grid 26. Said outer and inner two-dimensional grids 25,26 respectively represent the outer and inner surfaces of the lattice structure 11. Preferably, the helmet 10 comprises an outer shell 17 if the lattice structure 11 is made of an elastomeric material. A lattice structure 11 made of an elastomeric material is preferable in skateboard helmets, because it's able to efficiently absorb multiple and repetitive impacts. In this case, the shell 17 is preferably made of non elastomeric material and is connected to the outer 2D grid 25 of the lattice structure 11, with glue, mechanical connection or any other similar connection means.

The lattice structure 11 comprises on its inner side one or more pockets 19 for accommodating one or more energy absorbing pads 16. The single energy absorbing pad 16 of FIG. 5 is independent with respect to the lattice structure 11, and consequently it is able to slightly move with respect to the lattice structure 11. Where the pocket 19 is arranged, the thickness of the lattice structure 11 is reduced with respect to the portions wherein the energy absorbing pad 16 is not arranged. In these portions of the lattice structure 11 wherein the thickness is reduced, the lattice structure 11 is not weak or fragile, because the three-dimensional grid of the lattice structure 11 is more flexible and less fragile than EPS. The average thickness of the lattice structure 11 in correspondence of these pocket is about 10 mm, preferably 8 or 9 mm. In this way, a thicker energy absorbing pad 16 can be employed and better results in term of energy absorption of impacts are obtainable.

The pocket 19 of the lattice structure 11 comprises a base 20 and at least side wall 21, this base 20 and/or the side wall 21 are permeable to air in order to allow the transit of air from the lattice structure 11 to the energy absorbing pad 16. Preferably, the pockets 19 of the lattice structure 11, wherein energy absorbing pads 16 are arranged, can be shaped so to fasten said pads 16 for maintaining them in the pocket 19 without any additional connecting means. In particular, the at least a side wall is configured to prevent the coming out of the energy absorbing pad 16. This effect is obtained because the size of the innermost edge of the pocket 19, thus the aperture, is smaller than the size of the outermost surface of the energy absorbing pad 16, thus the bottom of the pocket 19.

Preferably, as shown in FIG. 5, between the lattice structure 11 and the energy absorbing pad 16 is arranged a low friction layer 31. The low friction layer 31 has on the inner and/or outer side a material defining a low coefficient of friction, preferably a coefficient of static friction less than 0.5. This low friction layer 31 is arranged on the bottom of said pockets 19 and faces the energy absorbing pad 19. The low friction layer 31 is made of a low friction material like PTFE, polycarbonate or nylon. This layer 31 allows a relative movement between lattice structure 11 and energy absorbing pad 16, which allows to reduce injuries to brain mass of the wearer in case of an impact. The pocket 19 is oversized with respect to the energy absorbing pad 16, so that a lateral gap of few millimetres is provided between them. In this way, the energy absorbing pad 16 is capable of sliding over the lattice structure 11 reducing the risk of damages on the brain mass. When the lattice structure 11 is made of an elastomeric polymer, preferably thermoplastic elastomer, the lattice structure 11 itself allows lateral movements of the wearer's head, contributing to the reduction of injuries to the brain mass.

Furthermore, the lattice structures 11 can have pass-through apertures which allow to a great volume of air to cross the lattice structure 11 and reach the energy absorbing pad 16. These pass-through apertures, visible in FIG. 5, contribute to form the vents 12 of the shell 17.

Alternatively, as shown in FIGS. 3 and 5, some apertures are blind and their lateral surface and/or their bottoms are solid so to form a blind vent 12". The bottom of the blind vent 12" can be holed, as shown in FIG. 5, in order to enable the transit of air through these holes. In alternative, the bottom of blind vent can be continuous and the lateral surfaces of these blind vent are holed for allowing the entrance of air into the lattice structure 11, as shown in FIG. 3. In this way, once the air is entered into the lattice structure 11, it is able to flow in the rest of the lattice structure 11, ventilating the entire wearer's head. As shown in FIG. 5, these blind vents 12" are shaped so to direct the air towards these holes of the bottom or lateral surfaces of the blind vent 12". Preferably, the blind vent 12" is convergent moving from the shell 17 toward the energy absorbing pad 16. In this way, the air in the blind vent 12"is forced to enter into these holes and a Venturi effect is generated which increases the airflow speed across the lattice structure 11, improving the ventilation effect. The air generated by the wearer progressive movement concentrates in these cavities thanks to the shape of the blind vents 12" themselves and then is forced to pass through said small holes. In this way, the airflow accelerates and can be spread more precisely through the lattice structure over the entire wearer's head. Furthermore, in this way the energy absorbing pad 16 is not directly exposed to external impacts with spike or pointed element. The bottom of these blind vents 12" work like a shield which protect the energy absorbing pad 16. These blind vents/cavities 12" are arranged in the front and/or in the back of the helmet 10 in order to allow an air transit when the user advances forward.

The embodiment of FIG. 6 is exactly equal to that of FIG. 5 except for the lattice structure 11 internal arrangement. In particular, the rods do not follow the shape of the energy absorbing pad 16 as in the previous embodiment, but they are all arranged according to the same logic. In particular the lattice structure 11 is an organized structure composed by unit cells having all the same 3D motif and the same dimension. These unit cells are repeated along the three principal axes of the space so to create the lattice structure 11. Each unit cell can be seen as a cubical unit containing a specific three-dimensional lattice body. In the embodiment of FIG. 6 the unit cells are placed side by side according to vertical and horizontal directions. All other features of this embodiment have been already described in the previous one. The unit cell can be of one of the following types: diamond face-centered cubic (DFCC), diamond hexagonal (DHEX), body-centered cubic (BCC), face-centered cubic (FCC). Alternatively, the lattice structure 11 can be made of a structure without rods or beams. For example, the lattice structure 11 can be organized with a honeycomb structure, a lattice wall honeycomb structure or other complex and porous prismatic/columnar structures such as gyroids or origami like structures. Even in these cases, the lattice structure is organized according to a common elementary unit cell that is repeated in the space.

Varying the internal arrangement of full portions 13 in the lattice structure 11 a functional grading of this cellular structure can be obtained. In particular, varying the size of the unit cell of the lattice structure 11 a variation of the behaviour of the lattice structure 11 itself can be achieved. Varying the unit cell dimension, the density of full portions 13 in the lattice structure 11 varies. In particular, if the volume of said unit cell increases moving radially from inside to outside of the lattice structure 11, as shown in FIG. 7D, the energy absorption of a load impact is significantly improved and the energy transmitted to the wearer's head is particularly reduced. The outer and bigger unit cells collapse first and gradually densify one over the other transmitting the load to the below and smaller unit cells. This dynamic collapse and densification reaction of the lattice structure 11 continues with the underlying layers of unit cells. In this way, the impact load is absorbed more efficiently. Even the lattice structure 11 of FIG. 5 shows this type of arrangement, with the only difference that unit cells grow laterally but not in the height direction. In the embodiment of FIG. 7D, the volume of the unit cell increases in all dimensions of the unit cells, thus along the height, the width and the depth. This means that more external unit cells identify cubes having bigger height, width and depth than that of more inner unit cells.

The energy absorbing pad 16 has a structure that enables the transit of airflow through it. As shown in FIG. 2-7, the energy absorbing pad 16 can be configured like that of patent EP1694152B1, that is herein incorporated by reference as regards the cells arrangement and energy absorbing pad construction. In this type of energy absorbing pad 16, the airflow coming from the lattice structure 11 flows through the cylindrical cells 28 of the energy absorbing pad 16 and reaches the wearer's head. The same applies if the cells 28 of energy absorbing pad 16 are structured like tubes having hexagonal or non-hexagonal base (not shown). The airflow passes through the tubes from their outermost edges towards their innermost edges. If the energy absorbing pad 16 is formed by an open-cell foam (not shown), the large part of cells are connected to each other so to realize a network of interconnected air channels, and the air can cross the pad along its thickness. In all these cases, the energy absorbing pad 16, in addition to provide an energy absorbing function, allows the transit of air contributing to a more efficient ventilation of the entire user head. As explained, the energy absorbing pad 16 is permeable because it enables the transit of air across itself. In the traditional helmets and in said improved helmets the air can reach the user head only where the EPS layer is holed. In the present helmet, air passes through some of the following permeable elements so to reach the entire wearer head: lattice structure 11, energy absorbing pad 16, outer shell 17, outer 2D grid 25, inner layer 18, inner 2D grid 26, vents 12,12' or apertures/cavities 12".

The material of the lattice structure 11 is preferably an elastomeric polymer, for example a thermoplastic polyurethane (TPU) when multiple impacts need to be absorbed, like in case of skateboard helmet. Since the TPU is reversible, the helmet maintains its shape and behaviour even after an impact. The material of lattice structure 11 is preferably a non-elastomeric polymer, for example polyamide (PA) when a higher quantity of energy needs to be absorbed, like in bike helmets. In this case, the full portions 13 undergo to a plastic deformation absorbing a large quantity of energy. In this case, the lattice structure 11 involved in the impact is irreversibly sacrificed.

According to any one of preceding embodiments, the protective functions of the helmet 10 are differentiated for each layer. The lattice structure 11 is configured to absorb impacts that come from almost any direction by means of its 3D network of full portions (rods) 13 and to distribute the impact load on the external surface of the energy absorbing pad 16. The force of impact tends to compress the energy absorbing pad 16 against the user head. Since the energy absorbing pad 16 is structured so to maximize its energy absorbing property if its cells 28 are compressed according to their longitudinal axes, the protection effect is thus maximized.

A part from the internal arrangement, the lattice structure 11 and the energy absorbing pad 16 are also different in term of materials employed, for optimizing the mechanical properties of helmet. Cells 28 of energy absorbing pad 16 are made of polycarbonate, polyester or polypropylene and absorb compression load by plastic deformation. In a particular embodiment, energy absorbing pad 16 can include honeycomb made of paper or aluminium. The lattice structure 11 is made of polyamide or elastomeric material for spreading efficiently the impact load on a wider area of the energy absorbing pad 16.

As shown in FIG. 2-7, the energy absorbing pad 16 comprises a plurality of short tubular cells 28 connected to each other along their sides so to form a honeycomb panel. Initially, the honeycomb panel is flat and all longitudinal axes of these cells 28 are parallel each other. Subsequently, the panel is thermoformed on a curved surface like a standard headform, so to bend the panel and to form the energy absorbing pad 16 having a curved shape. After the bending activity of the panel, the axes of the cells become oriented according to a radial direction and are no more parallel each other. Alternatively, the honeycomb panel can be auxetic so to conform more easily to a headform without any thermoforming. Thanks to its double curvature, an auxetic geometry contracts in-plane when it is subjected to out-of-plane compression, providing a sort of inherent local reinforcement. These cells 28 are substantially radially oriented with respect to a geometrical center of the inner empty space of the helmet 10 configured for receiving the wearer's head. This orientation of the cells 28 allows to absorb efficiently impact coming radially on the external surface of the pad 16. As already explained, the load of impact is spread on the lattice structure 11 and distributed, almost uniformly, by the lattices structure 11 on a wide area of external surface of the energy absorbing pad 16. The energy absorbing pad 16 thus receives the energy of the impact according to normal directions to its external surface and consequently the cells tend to be compressed according to their longitudinal axes. In this way, the compressed cells would tend to bend laterally, but since they are connected to each other, the only deformation admitted for them is to crush, collapsing along their longitudinal axes. In this way a maximum energy absorption is obtained. In the improved helmet cited in the background art chapter, this effect is not achievable because the EPS layer is not able to spread the energy on the energy absorbing pad. The EPS layer simply collapse absorbing energy and spread the load only on minimum surface of the energy absorbing pad.

The panel from which the pad is realized has a constant thickness, consequently also the pad 16 has a constant thickness between its inner and outer sides. This feature allows a better arrangement into the pocket of the lattice structure 11.

The honeycomb panel is obtained bonding lateral surfaces of adjacent cells 28 each other. The bonding is realized through heating the cells until they fuse together or by gluing or welding them together. Subsequently, the panel is bent by thermoforming in order to obtain the curved-shaped energy absorbing pad 16.

The lattice structure 11 is manufactured by additive manufacturing, also known as 3D printing. Preferably the lattice structure 11 is manufactured by layer-by-layer manufacturing technologies. The lattice structure 11 is not entirely lattice and, a part from rods 13, can includes further portions which are full, like the shell or the plates for connecting the retention straps. Also the inner and/or outer two-dimensional grids 25,26 can be 3D printed together with the lattice structure 11, so to make them monolithic and in a single piece. Other elements of the helmet, like the shell 17, the ribs 15 or the plates can be 3D printed together with the lattice structure 11, in order to provide an improved structural resistance to the entire item. Alternatively, the shell 17 is connected to the lattice structure 11 by means of glue or through a snap-fit connection. Preferably, the lattice structure 11, together with its pockets 19 and blind vents 12", is realized through selective laser sintering technology or stereolithography which are currently used to create extremely lightweight, intricate and high resolution cellular structures. Also the pockets 19 of the lattice structure are realized by additive manufacturing together with the rest of lattice structure 11. If this protective pad would be made of EPS, this pockets would be inner undercuts to an almost dome-shaped helmet. These kind of undercuts are very complicated to be realized with moulding, and the moulder needs to be extremely competent in order to avoid damages to the EPS structure. Through additive manufacturing all these problems are solved.

As shown in FIG. 7C, the lattice structure 11 realized by additive manufacturing has an overall curved shape. Internally, the lattice structure 11 comprises full portions shaped as rods 13, which are oriented in several directions of the space. The lattice structure 11 comprises a plurality of rods 13 radially oriented, thus normal to the inner and outer two-dimensional grids 25,26. Oblique rods 13 branch laterally from the radial rods 13 towards other radial rods. In this way a 3D network of rods 13 is realized and the energy of an impact is spread on a plurality of rods 13 involving a great portion of the lattice structure 11. If the lattice structure 11 would be made of columnar elements, this effect would not be obtainable. Furthermore, this kind of lattice structure 11 can be realized easier with respect to other architectures, because, during layer-by-layer 3D printing, each rods 13 constitute a support for the closest one. Overhang rods 13 requires a support when they reach a certain length, otherwise they collapse. In the present lattice structure 11 at least a neighbour rod 13 constitutes a support for another overhang rod 13, allowing the realization of the entire structure. Since a helmet 10 is almost a hemispherical item, several rods 13 are overhang during 3D printing. Due to this internal arrangement of rods 13, the 3D printing of this lattice structure 11 is facilitated.

As already described, the helmet can comprise a shell 17 covering certain portions of the outer side of the lattice structure 11, an inner layer 18 covering certain portions of the inner side of the lattice structure 11, or, in a hybrid version of the helmet 10, both a shell 17 covering certain portions of the outer side of the lattice structure 11 and an inner layer 18 covering certain portions of the inner side of the lattice structure 11.

As already described the outer shell 17 can be monolithic with or connected to the lattice structure 11. The shell 17 can cover the large part of lattice structure 11, for example for winter sports' helmet, or can cover only a portion of the lattice structure for enabling a great passage of air, for example for helmets dedicated to bike or American football.

The lattice structure 11 can assume any internal arrangement of full portions, but certain arrangements have been studied and provide specific effects. Any lattice structure 11 is composed by full portions 13 and empty portions 14 which represent the empty spaces defined between full portions 13. Full portions 13 represent less than 30% of the encapsulating volume. In particular, the preferred structure is an organized structure having an elementary unit cell that is repeated. The unit cell can be shaped as one of, but not limited to, the following types: diamond face-centered cubic (DFCC), diamond hexagonal (DHEX), body-centered cubic (BCC), face-centered cubic (FCC). More specifically, Kagome and BCC structures exhibit exceptional strength properties in compression and shear. In particular, they work better in compression because the length of a rod contributes in a quadratic manner to load it can carry. Other arrangement of the rods of the lattices structure 11 can be used, in particular are preferred the lattice structures 11 wherein the full portions 13 are configured to bend when the lattice structure 11 is compressed along a radial direction. The term radial means a direction oriented from the center of symmetry of the helmet outwards, more specifically the term radial direction means a direction normal to the inner surface of the lattice structure 11, which substantially corresponds to the wearer's cranium shape. Example of these kinds of lattice structures 11 are shown in FIG. 7A-7C. In particular, FIG. 7A illustrates a tetrahedral lattice structure (second image from the top of FIG. 7A) which can have an outer and an inner 2D triangular grids 25, 26. If the grids 25,26 and the body 11' of the lattice structures 11 are bonded each other, a more complex single piece lattice structure 11 is obtained, as represented in the bottom drawing of FIG. 7A. Similarly, FIG. 7B illustrates a pyramidal lattice structure (second image from the top of FIG. 7B) which can have an outer and an inner 2D triangular grids 25, 26. If the grids 25, 26 and the body 11' of the lattice structures 11 are bonded to each other, a more complex single piece lattice structure 11 is obtained, as represented in the bottom drawing of FIG. 7B. Finally, FIG. 7C illustrates a 3D Kagome lattice structure (second image from the top of FIG. 7C) which can have an outer and an inner hexagonal/triangular 2D grids 25, 26. If the grids 25, 26 and the body 11' of the lattice structures 11 are bonded each other, a more complex single piece lattice structure 11 is obtained, as represented in the bottom drawing of FIG. 7C. The lattice structure 11 is preferably configured and structured so to follow the shape of energy absorbing pad 16, as shown in FIG. 5. In this way, if an impact reach the helmet 10 according to a radial direction, as it normally occurs, at least a group of rods 13 is oriented radially, so parallel to the impact direction and at least a group of rods 13 is oriented diagonally or orthogonally with respect to the impact direction, as shown in FIG. 7C. This arrangement of the rods 13 allows to spread more efficiently the impact load on a wider surface of the underneath energy absorbing pad 16. Alternatively, the evolution of the lattice structure 10 can be vertical, thus all horizontal layers of unit cells are aligned in the same orientation as the neighbouring unit cell when a cross section of the lattice structure 11 is observed laterally as shown in FIG. 6. This structural arrangement is easier to be 3D printed.

Figure 8A:
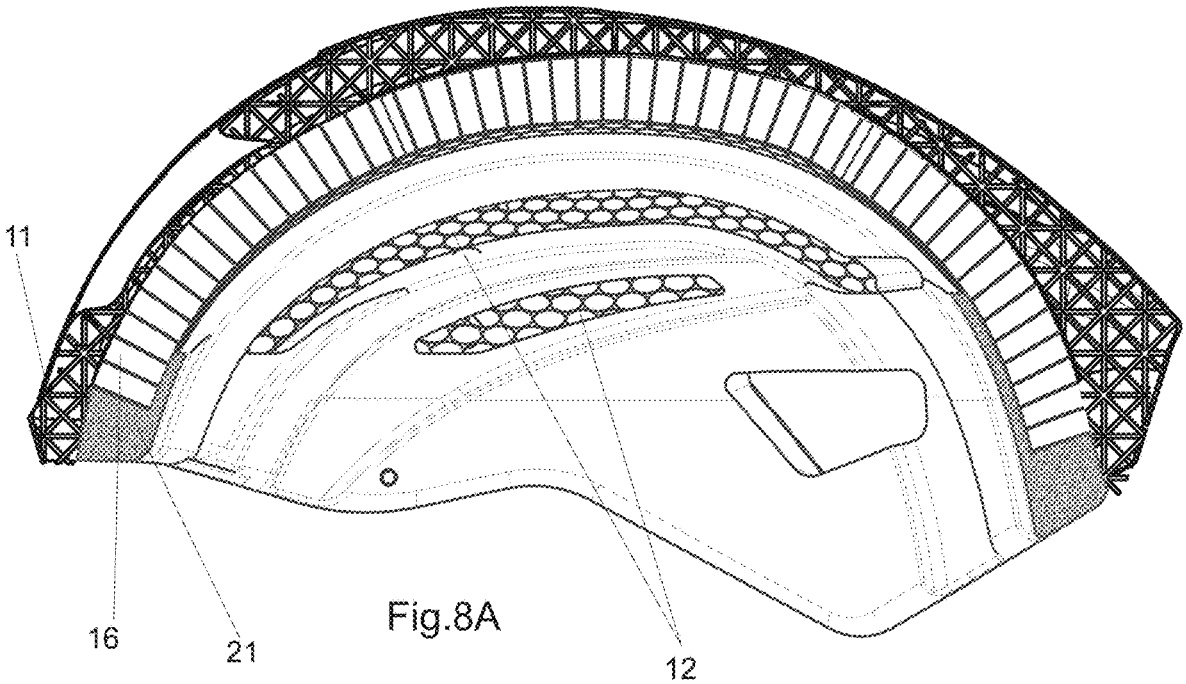
FIG. 8A shows a helmet according to a sixth embodiment of the present invention.
Figure 8B:
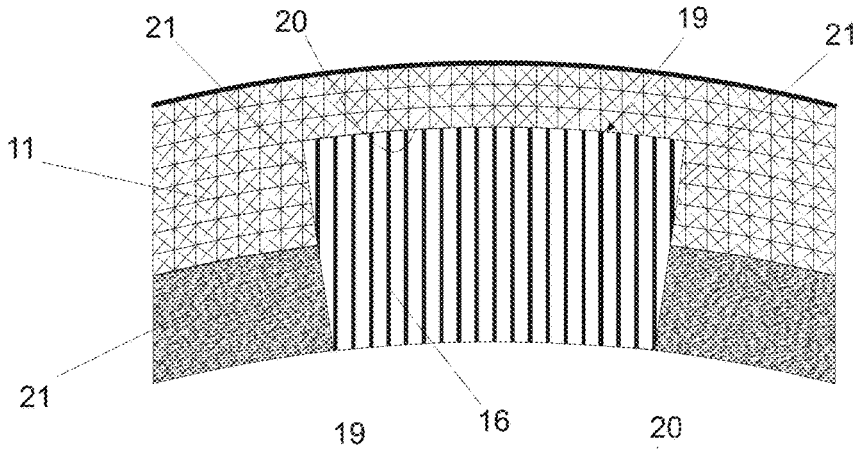
FIGS. 8B and 8C show alternative arrangements of the elements constituting the helmet of FIG. 8A.
Figure 8C:
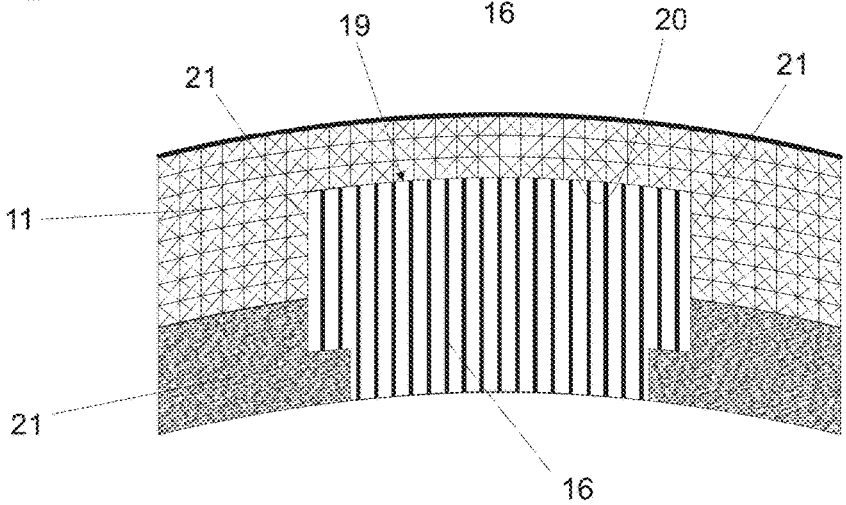

Advantageously, the helmet can comprise a layer 21 of EPS or EPP, as shown in FIG. 8A-8C, arranged below the lattice structure 11 and beside and partially over the energy absorbing pad 16. In the first case, represented in FIG. 8B, the EPS or EPP layer 21 surrounds the energy absorbing pad 16, while in the second case, represented in FIG. 8C, it partially overlaps the energy absorbing pad 16. In both cases, the energy absorbing pad 16 is clamped in-between the lattice structure 11 and EPS/EPP layer 21. The EPS/EPP layer 21 improves the comfort of the helmet 10 and also avoids a mechanical connection between lattice structure 11 and energy absorbing pad 16. Indeed, the energy absorbing pad 16 remains trapped between lattice structure and EPS/EPP layer. Alternatively, the EPS/EPP layer can be a layer made of any closed-cell polymeric foam. Furthermore, the EPS/EPP layer 21 is very easy to be realized in this way, because inner undercuts are drastically reduced or eliminated, and consequently the EPS/EPP layer can be moulded easier.

A further object of the present invention is a method for manufacturing the helmet comprising two main steps. The first step foresees to provide a lattice structure shaped so to receive a part of a user head. This lattice structure has to comprise at least one inner pocket. The second step foresees to insert at least one energy absorbing pad, which is permeable to air, into said at least one pocket. The lattice structure 11 is realized through additive manufacturing, and the energy absorbing pad is realized by bonding lateral surfaces of adjacent cells so to form a honeycomb panel. The honeycomb panel is then thermoformed on a curved mould so to give it a curved shape that fits with that of said pocket. This method allows to assembly and manufacturing very fast a helmet for sport activities.

Notwithstanding the helmet of the present invention is suitable for sport activities, the present scope of protection includes helmets having the same features but employed in different fields, like that of motorcycle/automotive/aircraft helmets or industrial safety helmets.

Concluding, the invention so conceived is susceptible to many modifications and variations all of which fall within the scope of the inventive concept, furthermore all features can be substituted to technically equivalent alternatives. Practically, the quantities can be varied depending on the specific technical exigencies. Finally, all features of previously described embodiments can be combined in any way, so to obtain other embodiments that are not herein described for reasons of practicality and clarity.

The invention claimed is:

1. A helmet comprising:

a lattice structure shaped so as to accommodate a part of a user's head and comprising empty and full portions arranged so that a continuous network of interconnected air channels runs through the lattice structure;

at least one energy absorbing pad permeable to air comprising a plurality of cells and adjacent cells are interconnected with each other on a portion of their lateral surfaces to form an array of energy absorbing cells;

wherein on an inner side of the lattice structure at least one pocket is provided, said at least one pocket is permeable to air and accommodates said at least one permeable energy absorbing pad; and, wherein each of said at least one pocket comprises a base and at least a side wall, wherein said base is permeable to air.

2. The helmet according to claim 1, comprising an outer shell connected to the full portions of the lattice structure, and said outer shell being configured to cover at least in part the lattice structure.

3. The helmet according to claim 1, comprising an inner layer connected to the full portions of the lattice structure, said inner layer being arranged at least in part between the lattice structure and the at least one permeable energy absorbing pad.

4. The helmet according to claim 1, wherein said plurality of cells are tube-shaped, honeycomb shaped, non-hexagonally-honeycomb-shaped, or form an open-cell foam.

5. The helmet according to claim 2, wherein said outer shell is at least in part permeable to air and is a two-dimensional grid.

6. A helmet comprising:

a lattice structure shaped so as to accommodate a part of a user's head and comprising empty and full portions arranged so that a continuous network of interconnected air channels runs through the lattice structure;

at least one energy absorbing pad permeable to air comprising a plurality of cells and adjacent cells are interconnected with each other on a portion of their lateral surfaces to form an array of energy absorbing cells;

wherein on an inner side of the lattice structure, at least one pocket is provided, said at least one pocket is permeable to air and accommodates said at least one permeable energy absorbing pad; and wherein the lattice structure is covered by an outer shell which covers a top portion of the lattice structure, the outer shell being connected to the lattice structure.

7. The helmet according to claim 6, wherein the shell is connected to the lattice structure through glue or mechanical connections.

8. The helmet according to claim 6, wherein the outer shell comprises a plurality of vents for admitting air and through at least one of these vents is visible the permeable energy absorbing pad.

9. The helmet comprising:

a lattice structure shaped so as to accommodate a part of a user's head and comprising empty and full portions arranged so that a continuous network of interconnected air channels runs through the lattice structure;

at least one energy absorbing pad permeable to air;

a layer made of a polymeric foam arranged below the lattice structure and beside and partially over the at least one energy absorbing pad so as to at least partially surround the energy absorbing pad.

10. The helmet according to claim 9, wherein the at least one energy absorbing pad is clamped in-between the lattice structure and the polymeric foam layer.

* * * * *